US007450879B2

(12) United States Patent
Ito et al.

(10) Patent No.: US 7,450,879 B2
(45) Date of Patent: Nov. 11, 2008

(54) IMAGE FORMING APPARATUS HAVING A MEMBER FOR REMOVING DUST FROM AN IMAGE CARRIER

(75) Inventors: Yoshinori Ito, Toyokawa (JP); Hiroya Fukuta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 119 days.

(21) Appl. No.: 11/466,634

(22) Filed: Aug. 23, 2006

(65) Prior Publication Data

US 2007/0048000 A1 Mar. 1, 2007

(30) Foreign Application Priority Data

Aug. 23, 2005 (JP) ..... 2005-241211

(51) Int. Cl.
*G03G 21/00* (2006.01)

(52) U.S. Cl. ..... 399/98; 399/343; 399/353

(58) Field of Classification Search ..... 399/98, 399/102, 343, 353, 354
See application file for complete search history.

(56) References Cited

U.S. PATENT DOCUMENTS 5,436,700 A * 7/1995 Kikuchi et al. ..... 399/98 X
5,991,568 A * 11/1999 Ziegelmuller et al. ..... 399/102
6,385,414 B1 * 5/2002 Sato et al. ..... 399/98
7,031,634 B2 * 4/2006 Ziegelmuller et al. ..... 399/102

FOREIGN PATENT DOCUMENTS

JP 4-050890 A 2/1992
JP 2001-242755 A 9/2001

* cited by examiner

*Primary Examiner*—Sandra L Brase
(74) *Attorney, Agent, or Firm*—Banner & Witcoff, Ltd.

(57) ABSTRACT

An image forming apparatus is provided which includes a rotating image carrier including a central portion and tip portions, and a rotating developing element for contacting the rotating image carrier and applying a developer to a latent image, wherein an axial direction is parallel to an axial direction of the rotating image carrier, and the element includes tip portions at ends in the axial direction. Also, the apparatus includes a member for removing dust from the central portion of the rotating image carrier, a width of the member being less than a width of the rotating developing element and a width of the rotating image carrier in the axial direction of the rotating image carrier, and a dust collector for collecting dust removed by the member, and having a width greater than the width of the rotating developing element in the axial direction of the rotating image carrier.

19 Claims, 9 Drawing Sheets

IMAGE FORMING APPARATUS HAVING A MEMBER FOR REMOVING DUST FROM AN IMAGE CARRIER

CROSS REFERENCE TO RELATED APPLICATION

This application claims priority from Japanese Patent Application No. 2005-241211, filed on Aug. 23, 2005, the entire subject matter of which is incorporated herein by reference.

FIELD

Aspects of the present invention relate to an image forming apparatus that forms an image by developing a latent electrostatic image formed on an image carrier.

BACKGROUND

Conventionally, an image forming apparatus forms an image by the development of an electrostatic latent image on a photosensitive drum.

This type of imaging apparatus is equipped with a fully detachable process unit for easy supply of toner. This process unit includes a photosensitive agent cartridge housed with a peripheral mechanism surrounding a photosensitive drum (image carrier), a toner tank that stores toner, and a development roller that carries and supplies toner to the photosensitive drum, etc. In essence, it is an image developing cartridge including a mechanism for development using toner. The image developing cartridge is fully detachable from the photosensitive agent cartridge.

As shown in FIG. 9, the cartridge casing 200 of the photosensitive cartridge contains a photosensitive material drum 201, a transfer printing roller 202 that transfers printing of a visible image (toner image) developed by the toner from an electrostatic latent image on the photosensitive drum 201 to paper P1, a conductive brush 203, and a lower film 204 which is placed so that it blocks a gap between the photosensitive drum 201, and the cartridge casing 200 so that it is able to retain the paper dust removed from the surface of the photosensitive drum 201 by the conductive brush 203 in the cartridge casing 200.

An electrode bias is applied on the conductive brush 203 to remove paper dust from the photosensitive drum 201 to prevent current leakage between the photosensitive drum 201 and the conductive brush 203. The conductive brush 203 is installed in a manner in which it is not in contact with both ends of drum in the axial direction of the photosensitive drum 201.

In other words, the tips of the conductive brush 203 along the axial direction of drum are situated toward the central part of the drum in the axial direction of drum away from the ends of the photosensitive drum 201. To be more precise, the conductive brush 203 is narrower in the lengthwise direction than the photosensitive drum 201 is in the axial direction.

As described above, the lower film 204 is located under the conductive brush 203 and is installed so as to retain the paper dust removed by the conductive brush 203 from the drum 201. In other words, the edge of the lower film 204 in the axial direction of the drum 201 is installed so that the edge extends below the axial direction of drum in relation to the edges of the conductive brush 203 in the axial direction of the drum. That is, the length of the lower film 204 in the axial direction of the drum is slightly longer than the length of the conductive brush 203 in the axial direction of the drum 201.

As described above, in both ends of the drum 201 there are segments that are not in contact with the conductive brush 203 (hereinafter referred to as a non-cleanable area). Hence, the paper dust on the non-contact segments (hereinafter "non-cleanable area") cannot be removed from the drum 201 by the conductive brush 203.

In other words, the paper dust adhering to the non-cleanable area is the part where the periphery of the photosensitive drum 201 is in contact with the periphery of a development roller (not shown). As a result, the dust may be transferred from the periphery of the photosensitive drum 201 to the periphery of the development roller. The paper dust transferred to the periphery of the development roller will eventually accumulate in 1) the gap between the development roller and a side seal configured to prevent toner leakage from the end of the development roller or 2) in a toner tank which supplies toner to the development roller.

When the paper dust accumulates in the gap between the side seal and the development roller, the paper dust attracts the toner which can cause a toner leak. Additionally, when the paper dust accumulates in the toner tank, the electrostatic charge capacity of the toner in the toner tank is decreased, which can result in uneven toner application to the drum 201.

SUMMARY

Illustrative aspects of the invention relate to preventing the adhesion of dust to a non-cleanable area of the photosensitive drum.

According to at least some aspects of the invention, an image forming apparatus is provided including a rotating image carrier for carrying a latent image, the image carrier including a central portion and tip portions; and a rotating developing element for contacting the rotating image carrier and applying a developer to the latent image to form a visible image on the rotating image carrier, an axial direction of the rotating developing element being parallel to an axial direction of the rotating image carrier, the rotating developing element including tip portions at ends in the axial direction of the rotating image carrier. The apparatus further may include a member for removing dust from the central portion of the rotating image carrier, a width of the member in the axial direction of the rotating image carrier being less than a width of the rotating developing element and a width of the rotating image carrier in the axial direction of the rotating image carrier; and a dust collector for collecting dust removed from the rotating image carrier by the member, the dust collector having a width greater than the width of the rotating developing element in the axial direction of the rotating image carrier.

DETAILED DESCRIPTION

Illustrative aspects of the present invention are described with reference to the drawings.

Figure 1:
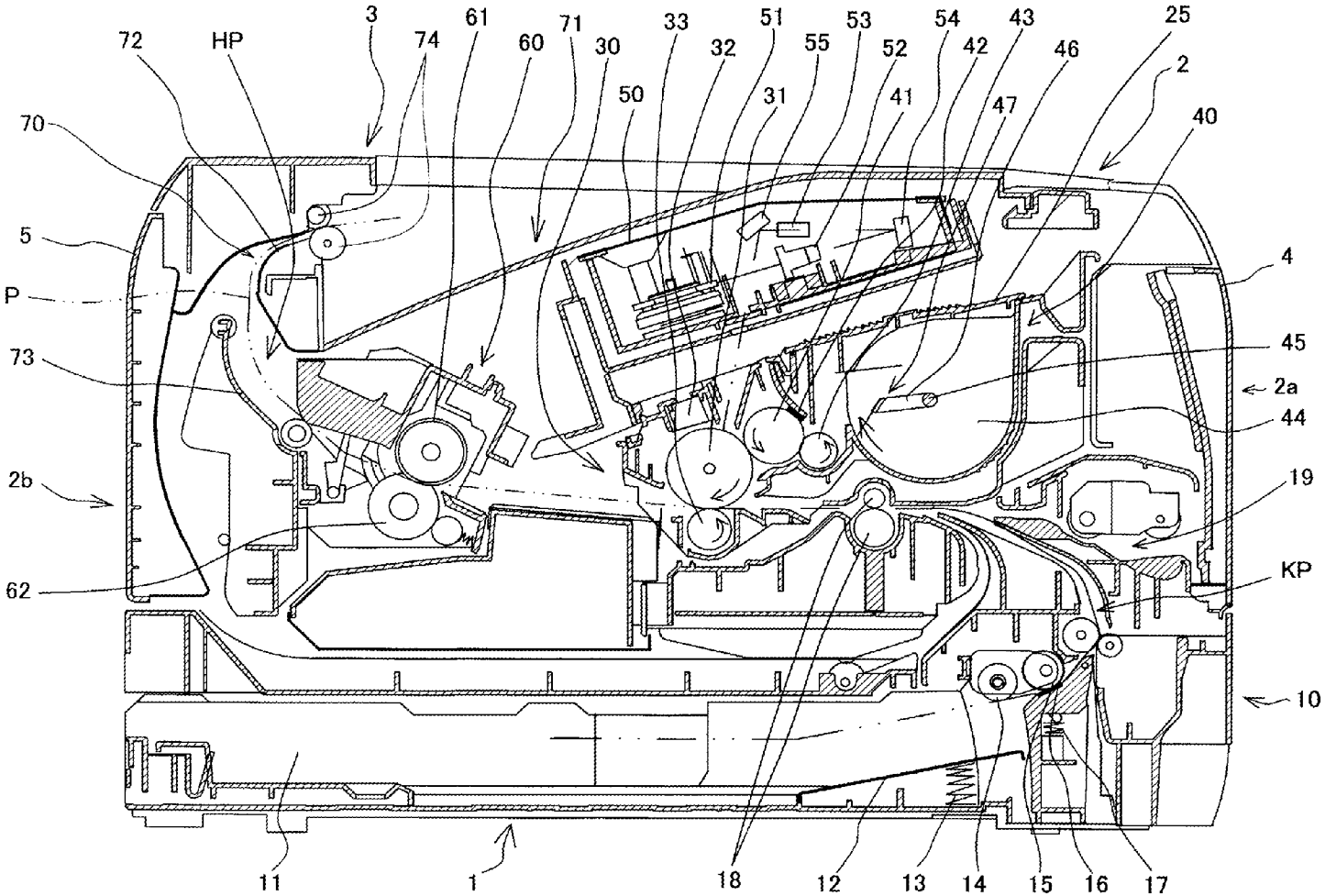
FIG. 1 is a simplified cross-sectional view of a laser printer according to illustrative aspects of the invention.

FIG. 1 is a cross-sectional view of the laser printer 1.

The casing 2 includes a top surface 3, a bottom surface and four sides including the front side portion 2*a* and the back side portion 2*b*. The top surface 3 slopes downward toward the back side portion 2*b*, the sloping portion of the top surface 3 forming a recording medium ejection tray 71. Immediately above the bottom surface of the casing 2, there is a cassette 11, which stores a stack of recording medium (e.g., paper) and can be fully removed through the front portion 2*a* of the casing 2. On the front portion 2*a*, there is a recording medium feed part 19 through which the recording medium can be inserted manually and a front cover 4 which can be opened and closed. The back side portion 2*b* includes a rear cover 5 which can be opened and closed.

The laser printer 1 further includes a recording medium feed part 10 (the path of the recording medium is indicated by solid imaginary line KP, followed by a broken imaginary line P including the broken imaginary line HP) for supplying the recording medium; a process unit 25 which can form a visible image on the recording medium; a fixation unit 60 which fixes the formed image on the recording medium; and a recording medium ejection part 70 in which the recording medium that has passed the fixation unit 60 is ejected.

The feed part 10 includes a feed cassette 11, and the feed rollers 14, 15, and feed pad 16 located at the front side of the recording medium in the feed cassette 11. In the feed part 10, a feed path KP begins in which the recording medium fed from the feed cassette 11 can be fed to the portion under the process unit 25 to form the recording medium transfer path. Below the process unit 25 is a resist roller pair 18 straddling the feed path KP. The recording medium may enter the feed path KP from the paper feed cassette 11, or by way of a feed part 19 through which the recording medium may be manually inserted. In each of the feeding methods, the recording medium is stopped once at the resist roller pair 18 then fed to the process unit 25 in synch with the image formation controlled by the process unit 25.

The feed cassette 11 is located under the process unit 25 and the fixation unit 60. The feed cassette 11 is also equipped with a pressing plate 12 and spring 13. The pressing plate 12 keeps the recording medium in a stack and pivots at the edge far from the feed roller 14, etc. and the portion of the plate 12 near the roller 14 can be moved up and down. In addition, the spring 13 presses the backside of the pressing plate 12 near the roller 14, etc. so that the plate 12 can be moved up and down. Hence, the pressing plate 12 moves downward against the force of the spring 13 when the recording medium volume is increased.

The feed roller 15 and feed pad 16 are installed opposite to each other. The feed pad 16 presses on the feed roller 15 by the spring 17 on the backside of the feed pad 16. The top sheet of the stack of recording medium on the pressing plate 12 is pressed to contact the feed roller 14 by the spring 13 located on the backside of the pressing plate 12. When a printing operation is started the feed roller 14 feeds the top sheet of the recording medium (e.g., paper) along the feed path KP to the feed roller 15. The feed roller 15 and feed pad 16 grab the recording medium with the rotation of the feed roller 15. As this process continues for additional sheets of the recording medium, the recording medium is fed sheet by sheet towards the feed path KP.

The recording medium fed from the feed cassette 11 or from the manual feed part 19 is sent to the resist roller pair 18 located above the feed roller 14, etc. The resist roller pair 18 aligns the recording medium and then feeds it to the process unit 25.

The scanning unit 50 located above the process unit 25 includes a laser source (not shown in the figure), a polygon mirror 51 driven by a high-speed motor, first scanning lens (an fθ lens) 52, second scanning lens (a cylindrical lens) 53, and reflecting mirrors 54 and 55.

The light beam modulated from the image information emitted from the laser source is passed and reflected in sequence through the polygon mirror 51, first scanning lens 52, reflecting mirror 54, second scanning lens 53, and reflecting mirror 55, as shown with a broken line, then subjected to an exposure-scanning process on the surface of a photosensitive drum 31 in the process unit 25.

The process unit 25 includes a photosensitive cartridge 30 and a development cartridge 40. The development cartridge 40 can be fully removed in relation to the photosensitive cartridge 30. Additionally, it includes a development roller 41, a film thickness controlling blade 42, a feed roller 43, a container 44, etc.

The developing agent in the container 44 is stirred by the rotation of an agitator 46 in the rotating direction shown by an arrow, driven by a rotating axis 45, and is discharged through the discharge outlet 47 of the container 44. On the side of the discharge outlet 47, a rotating feed roller 43 is attached. Opposite to the feed roller 43, a rotating development roller 41 is attached. The feed roller 43 and the development roller 41 are in contact with each other under a compressing force.

The development roller 41 includes a metal roller core and a conductive rubber material coating on the roller core, and is rotated in the direction shown with an arrow (counterclockwise direction). Additionally, the development roller 41 is constructed so that a development electrode bias is applied thereto. The film thickness controlling blade 42 is located near by the development roller 41. The film thickness controlling blade 42 includes an elastic metal sheet spring and an insulating silicone rubber on its edge, and the edge portion is curved in an arc. The blade 42 is positioned by a frame of the development cartridge 40 and the development roller 41, and the edge of the blade is pressed on the development roller 41 by a spring force exerted by the blade tip.

The developing agent discharged through the discharge outlet 47 is fed onto the development roller 41 by the action of the feed roller 43 rotating in counterclockwise direction. At this time, the developing agent is positively charged between the feed roller 43 and the development roller 41. The developing agent fed onto the development roller 41 enters into the gap between the pressing part of the film thickness regulator blade 42 and the development roller 41 by rotation of the development roller 41, and the agent is deposited on the development roller 41 as a thin film with a uniform thickness.

The photosensitive cartridge 30 is equipped with a photosensitive drum 31, an electric charger 32, a transfer printing roller 33, etc. The photosensitive drum 31 is configured so that it rotates in a direction opposite to the rotating direction of the development roller 41 in relation to the development roller 41 and it can also be rotated in the direction shown with an arrow (clockwise direction) in relation to the photosensitive cartridge 30. The photosensitive drum 31 is grounded and its surface is covered with a positively charged photosensitive layer made of polycarbonate.

The electric charger 32 is located at the upper left of the photosensitive drum 31 at a given distance in the opposite direction. The electric charger 32 is a positively charging Scorotron-type charger including a tungsten charging wire capable of generating corona discharge. The electric charger 32 charges the photosensitive drum 31 surface in a positive, uniform manner.

The transfer printing roller 33 is located under the photosensitive drum 31 and situated opposite from the photosensitive drum 31, and it is installed so that it rotates in the direction of the arrow (counterclockwise direction) in relation to the photosensitive cartridge 30. The transfer printing roller 33 is composed of a metal roller core which is coated with a conductive rubber material, and during the transfer printing, a transfer printing electrode bias is applied on the roller. A visible image (toner image) on the photosensitive drum 31 surface will be transfer printed onto the recording medium, while the recording medium is passing through the gap between the photosensitive drum 31 and the transfer printing roller 33 (hereinafter referred to as the transfer printing nip part).

Then the surface of the photosensitive drum 31 is positively charged in a uniform manner by the electric charger 32 with the rotation of the photosensitive drum 31, and is exposed by the laser beam from scanning unit 50 to form an electrostatic latent image.

Subsequently, with the rotation of the developing roller 41, the positively charged developing agent on the developing roller 41 is deposited on the electrostatic latent image formed on the surface of the photosensitive drum 31 when the developing roller 41 is in contact with the photosensitive drum 31. On the positively charged photosensitive surface of drum 31, the developing agent is deposited on the exposed portion after exposure to a laser beam. The exposed portion has a lower bias after laser beam exposure and the developing agent is selectively deposited on the exposed portion, then a developed image will be formed (transfer printed image).

Subsequently, the deposited developing agent on the surface of the developing drum 31 is transfer printed onto the recording medium while it passes through the gap between the photosensitive drum 31 and the transfer printing roller 33 (transfer printing nip part), and with the aid of the transfer printing bias applied to the transfer printing roller 33.

Figure 2B:
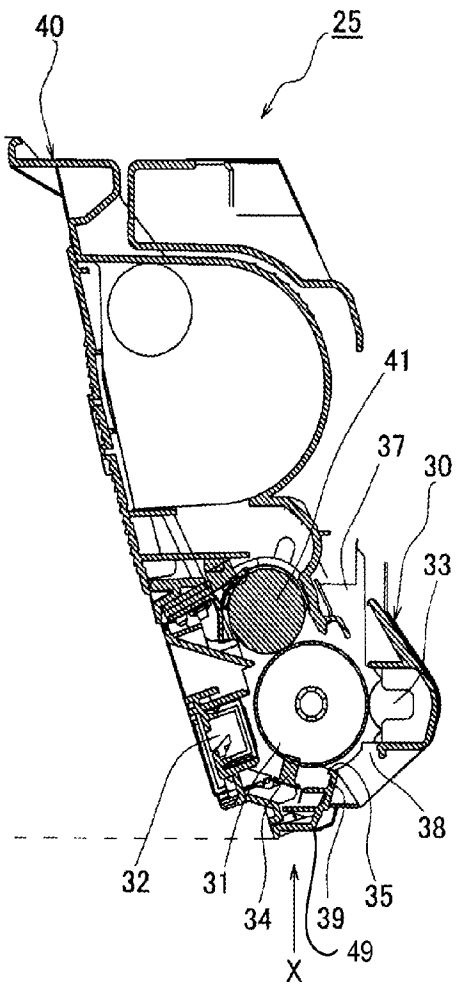
FIG. 2B is a cross-sectional view along the A-A axis of FIG. 2A.
Figure 2A:
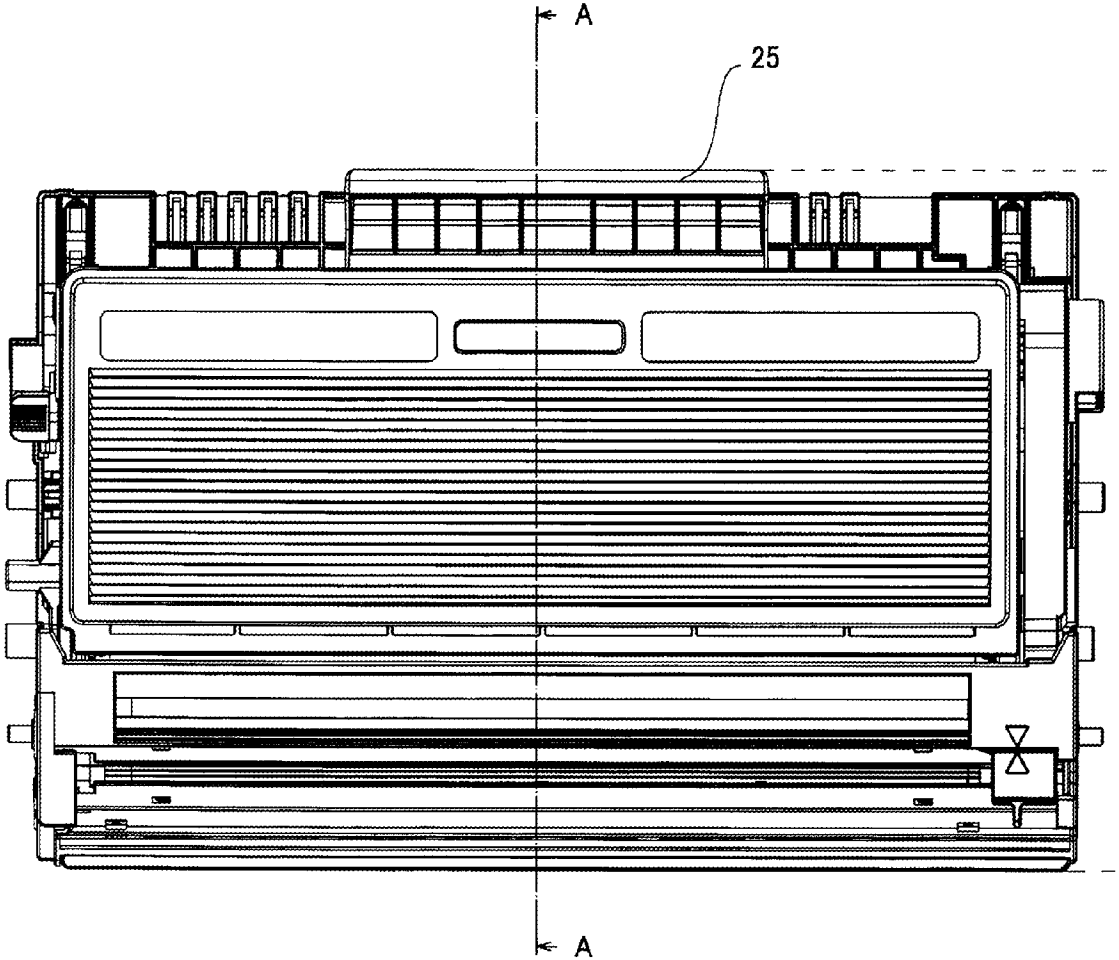
FIG. 2A is a top view of the process unit of FIG. 1.
Figure 3:
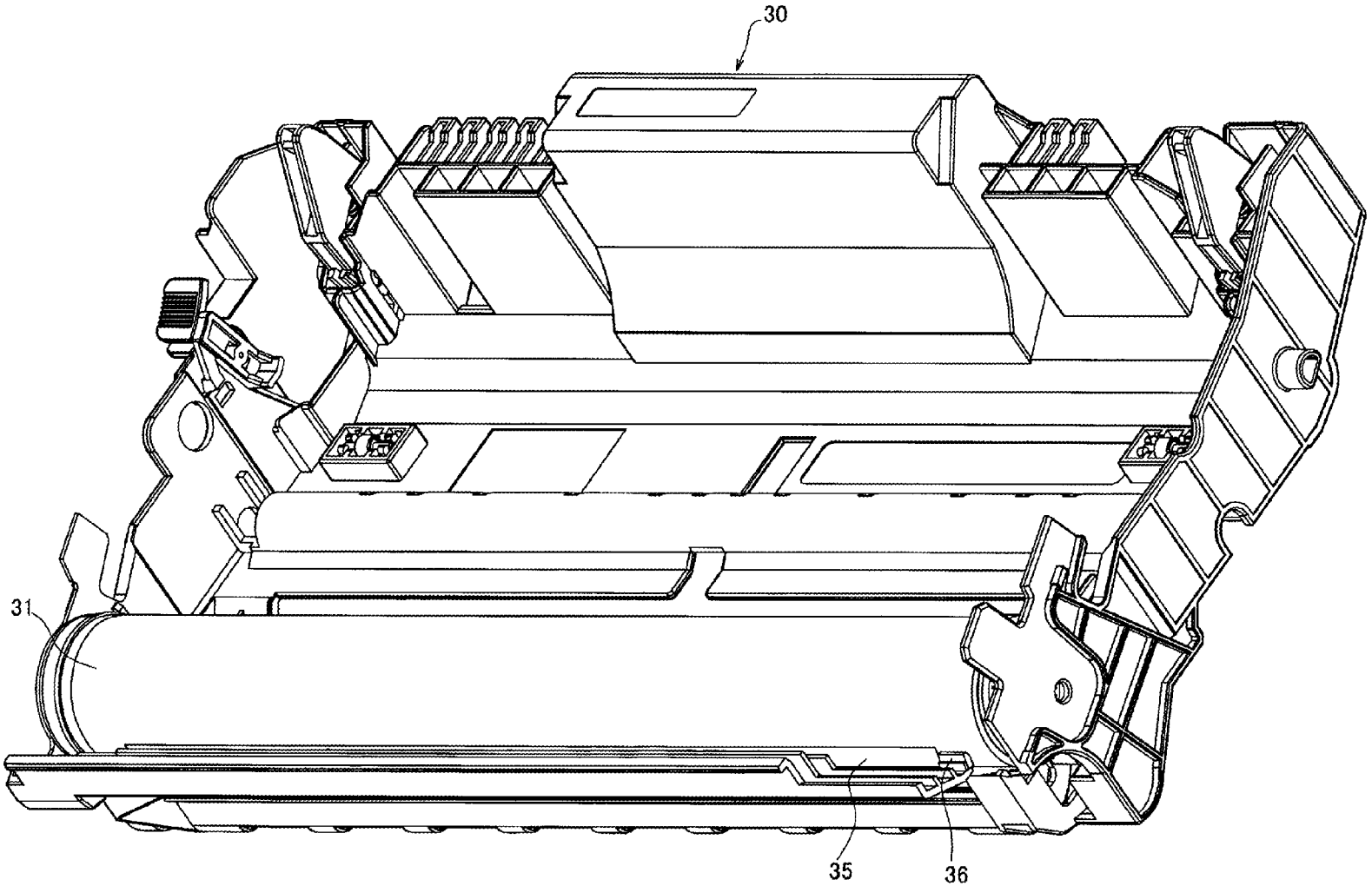
FIG. 3 is a perspective view of the core portion of the photosensitive cartridge of FIG. 1 according to an illustrative aspect of the invention.

FIG. 2A is a top view of the process unit 25. FIG. 2B is a cross-sectional view along the A-A axis of FIG. 2A. FIG. 3 is a perspective view of the core portion of a photosensitive cartridge 30, without the charger 32.

As shown in FIG. 2B, in the casing of the photosensitive cartridge 30, the recording medium feed part inlet 37 is installed so that a recording medium (e.g., sheet of paper) can be fed into the casing in the upstream end of the recording medium flow direction in relation to the transfer printing nip (the right side in FIG. 1). Additionally, an ejection portion 38 is installed to eject the recording medium out of the casing at the downstream end of the recording medium flow direction in relation to the transfer printing nip part (the left side in FIG. 1).

In the configuration, a conductive brush 34 is placed between the ejection portion 38 and the charger 32 (the left side of the photosensitive drum 31 in FIG. 1) opposite to the photosensitive drum 31 so that the tip of the brush is in contact with the surface of the photosensitive drum 31. An electrode bias is applied to the conductive brush 34. With contact between the photosensitive drum 31 and the recording medium at the transfer printing nip part, dust can be transferred onto the photosensitive drum 31. The conductive brush 34 then removes the dust from the photosensitive drum 31.

At an opening of the photosensitive cartridge 30 in the casing is an ejection portion 38. The top edge 49 of the photosensitive cartridge 30 above the ejection portion 38 protrudes in a horizontal (vertical in FIG. 2B) direction. The top edge 49 at both end parts (the direction along the rotational axis of the photosensitive drum 31 (hereinafter referred to as the axial direction of the drum)) is notched out to form the receiving end of a dust collector 39, where the dust removed by the conductive brush 34 is collected. An edge of the dust collector 39 is proximate to a surface of the photosensitive drum 31 such that a gap exists between the photosensitive drum 31 and the dust collector 39. A film 35 is provided between the photosensitive drum 31 and the dust collector 39 to fill the gap. The dust collector 39 collects the dust removed by the conductive brush 34 along with a film 35 (refer to FIG. 2B and FIG. 3).

As shown in FIG. 3, a protruding sponge material part 36 is installed on both ends of the tips on the film 35 along the axial direction of the drum 31. The protrusion extends out away from the film 35.

Figure 4:
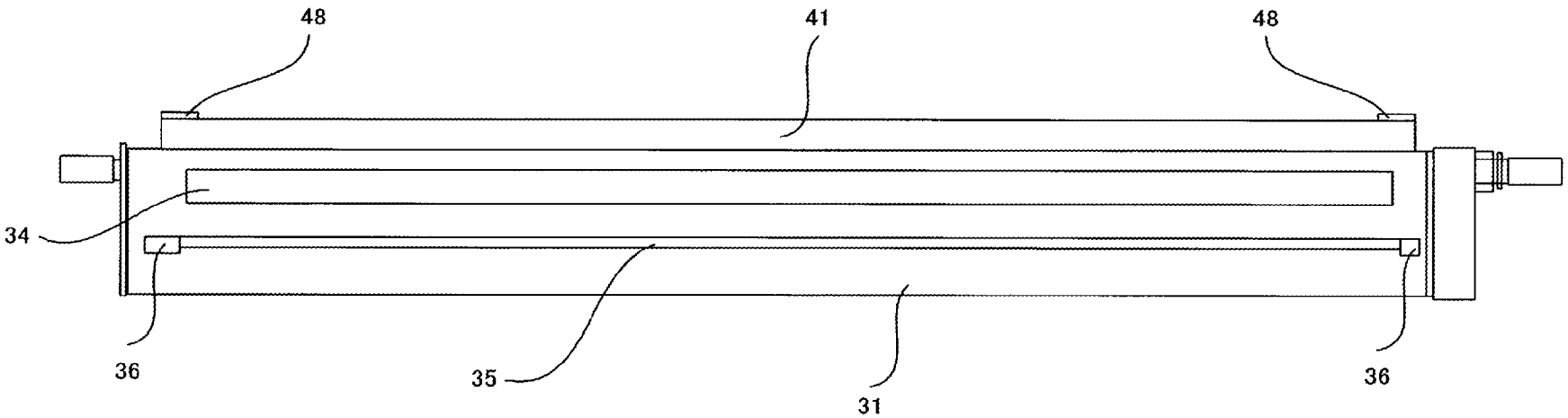
FIG. 4 illustrates the relationships and locations of the major parts of the photosensitive cartridge in FIG. 3.

FIG. 4 shows the relationships and locations of the photosensitive drum 31, the development roller 41, the conductive brush 34, the film 35, and the sponge material part 36. They are displayed in the view from the front of the process unit 25 (view from the "x" mark in FIG. 2B).

The width (brush width) of the conductive brush 34 in the axial direction of the drum is configured so that the entire contact area on the recording medium in contact with the photosensitive drum 31 is subjected to cleaning by the conductive brush 34 when the maximum recording medium size allowed by the laser printer 1 is used.

As shown FIG. 4, the width (film width) of the film 35 in the drum direction is slightly wider than the brush width of the conductive brush 34. The width of the film 35 allows the dust removed by the conductive brush 34 to be maintained in the dust collector 35.

The width of the development roller 41 in the axial direction of the drum is less than the width of the photosensitive drum 31 in the axial direction but greater than the width of the conductive brush 34. Furthermore, in development cartridge 40, a developing agent supported on development roller 41 is arranged such that, to prevent leakage from both ends of the development cartridge 40 in the axial direction of the development roller 41, a side seal 48 is placed on each tip of the development roller 41 so that the seal rubs the development roller 41.

The width in the axial direction of the drum of the sponge material part 36 plus the film 35 is less than the photosensitive drum width in the axial direction of the drum but greater than the width of the development roller 41.

As shown in FIG. 1, the fixation unit 60 is located above the feed cassette 11 and on the side of the process unit 25, and is on the downstream end of the recording medium path from the process unit 25. The fixation unit 60 is equipped with a heater-equipped heating roller 61 and is on a side of the recording medium path opposite a pressure roller 62. The pressure roller 62 presses on the surface of the heating roller 61. The heating roller 61 is a cylindrical metal cylinder in which both ends are opened and equipped with a heater, namely, a halogen lamp. The heater provides the heating that is necessary to fix the image on the recording medium.

The pressure roller 62 includes an elastomeric surface made of silicone rubber, etc., is covered with a PTFE (polytetrafluoroethylene) film, and is rotated by the action of the heating roller 61 while it is pressed by the heating roller 62.

The visible image, which is a transfer printed, developer image on the recording medium in the process unit 25, is thermally fixed while the recording medium is passing through the heating roller 61 and pressure roller 62 in the fixation unit 60. Subsequently, the recording medium is transferred to the recording medium ejection path HP in the paper ejection part 70.

The ejection part 70 includes an ejection tray 71 on the top surface 3, a recording medium ejection path HP including an inner guide part 72 and an outer guide part 73, and an ejection roller 74 located above the ejection tray 71 by the ejection outlet.

The ejection tray 71 is a flat, substantially rectangular shape and gradually slopes downward from the top surface 3 on the front cover side toward the back cover side. Additionally, the tray progressively slopes upward from the backside edge as it reaches to the front part. The recording medium that has passed through the fixation unit 60 and been transferred into the recording medium ejection path HP is then directed upward and deflected by the inner guide part 72 and the outer guide part 73, then ejected toward the front side of the ejection tray 71 via ejection roller 74.

On the periphery of the photosensitive drum 31 in the laser printer 1, the conductive brush 34 is not in contact with the area (hereinafter referred to as the non-cleanable area) defined by the tips of the photosensitive drum 31 in the axial direction of the drum (hereinafter referred to as the drum tips) and the tips of the conductive brush 34 (hereinafter referred to as the brush tips). Hence, it is likely that the dust adhering to the photosensitive drum 31 will accumulate and not be removed. Additionally, the area where the periphery of the photosensitive drum 31 is in contact with the conductive brush 34 is defined as cleanable area.

Furthermore, the tips of the brush are located toward the center in the axial direction of the drum away from the tips of the development roller 41 (hereinafter referred to as the development roller tip). Thus, a portion of the non-cleanable area is in contact with the periphery of the development roller 41. Therefore, it may be very possible that the dust adhering to the non-cleanable area of the photosensitive drum 31 migrates to the surface of the development roller 41.

One reason for the dust adhering to the non-cleanable area of the photosensitive drum 31 is that the dust is suspended in air after being removed by the conductive brush 34 and migrates to the tips of the photosensitive drum 31.

In the laser printer 1, the sponge material part 36 is in contact with a portion of both tips on the periphery of the photosensitive drum 31. At least some of the dust suspended in air after being removed by the conductive brush 34, where the sponge material part 36 is located, is collected by, for example adhering to, the sponge material part 36 and thus is prevented from reaching either tip of the photosensitive drum 31. In essence, the dust collected by the sponge material part 36 causes the dust adhering to the non-cleanable area to be reduced.

In this manner, the amount of dust migrating to the development roller 41 is reduced which can suppress toner leakage and uneven toner coverage.

Additionally, of the tips of the sponge material part 36 in the axial direction of the drum 31, the tip away from the film 35 (hereinafter referred to as the sponge outer tip) is located at the tip end of the axial direction of the drum away from the tips of the development roller tips. In other words, the development roller tips are located further inward from the drum tips toward the center part of the drum 31 than the sponge outer tip in the axial direction of the drum 31.

On the periphery of the photosensitive drum 31, the dust does not migrate to the development roller 41 if the dust adheres to the segment of the non-cleanable area between the sponge outer tips of the development roller 41 and the tips of the photosensitive drum 31 in the axial direction of the drum. This occurs because the development roller 41 is not in contact with this segment of the non-cleanable area.

Thus, the dust causing toner leakage and uneven toner coverage may be prevented in segments of the non-cleanable area where adhesion to the photosensitive drum 31 cannot be prevented (the portions from the outer edge of the sponge 36 to the edge along the axial direction of the drum 31) by the sponge material part 36dust.

Other aspects of the present invention will be discussed with reference to the drawings below. Only parts that differ from those described in the above aspects will be discussed.

Figure 5:
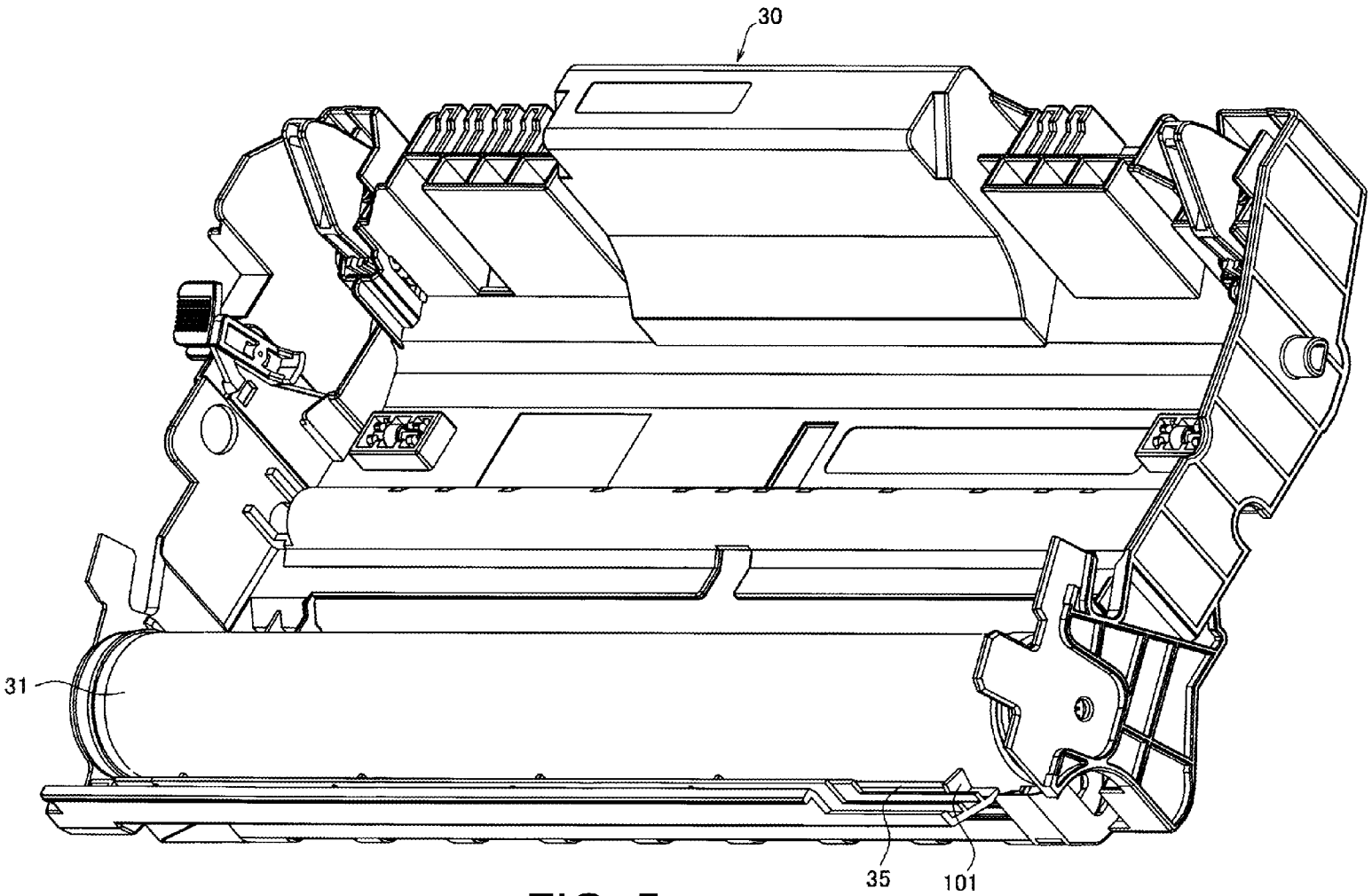
FIG. 5 is a perspective view of the core of the photosensitive cartridge of FIG. 1 according to another illustrative aspect of the invention.
Figure 6:
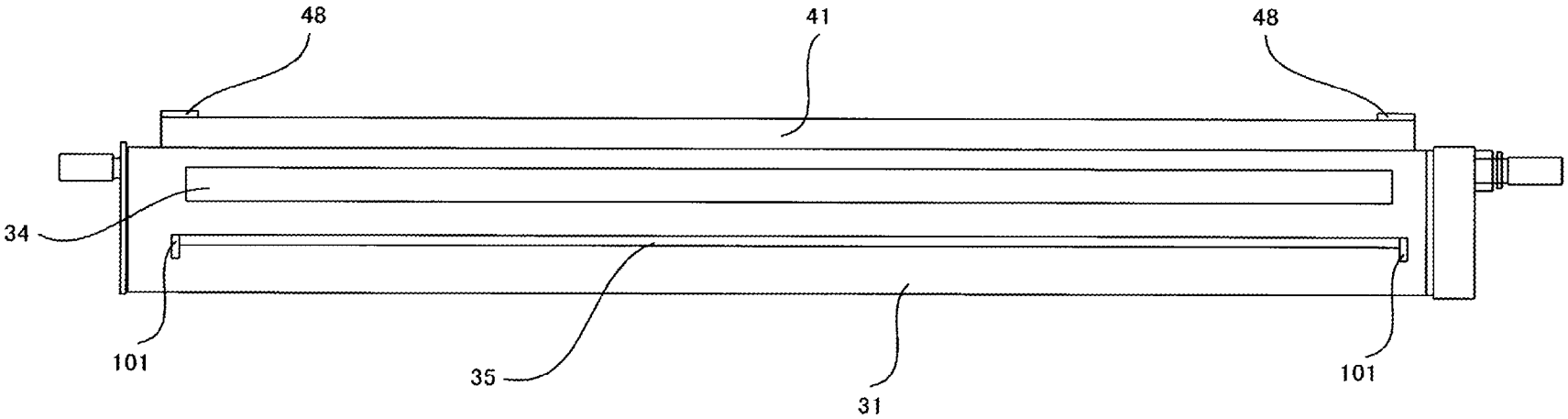
FIG. 6 illustrates the relationship and locations of the major parts of the photosensitive cartridge in FIG. 5.

FIG. 5 is a perspective view of the core of a photosensitive cartridge 30 according to another illustrative aspect of the invention. FIG. 6 is an illustration of the relationship and the locations of the photosensitive drum 31, a development roller 41, a conductive brush 34, a film 35, and wall parts 101 of FIG. 5.

As shown in FIG. 5 and FIG. 6, the difference between the laser printer 1 as compared with the aspects described above is the elimination of the sponge material part 36 and the addition of the wall parts 101dust.

The wall parts 101, as shown in FIG. 5, may protrude away from the axial direction of the photosensitive drum 31 at angle of between 75 and 105 degrees, for example in a perpendicular direction from the drum 31. A minimal gap may exist between the wall parts 101 and the photosensitive drum 31 to avoid damage to the drum 31 when a material (e.g., plastic) having a coefficient of friction greater than the coefficient of friction of the photosensitive drum 31 is used as the wall parts 101. When a material (e.g., a sponge) which has a coefficient of friction less than a coefficient of friction of photosensitive drum 31 is used, the wall parts 101 may contact the drum 31.

In such a laser printer 1, the migration of dust to the outer axial direction of the photosensitive drum 31 can be prevented when the dust is migrating along the axial direction of the drum from the center part to each tip part in the axial direction of the drum 31 (hereinafter referred to as the outer axial direction of image carrier). In this instance, the dust can contact a wall part 101 and may be diverted toward the film 35 or dust collector 39. The tips of the photosensitive drum 31 (drum tips) are situated beyond the wall parts 101 and therefore, migration of dust in the outer axial direction of the image carrier can be prevented by wall parts 101 and the amount of dust adhering to the non-cleanable area of the photosensitive cartridge can be reduced.

In this way, the amount of paper dust migrating into the development roller 41 can be reduced, which can suppress the toner leakage and reduce the possibility of uneven toner coverage.

Other illustrative aspects of the present invention will be discussed with reference to the drawings below. Only parts that differ from those in aspects described above will be discussed.

Figure 7:
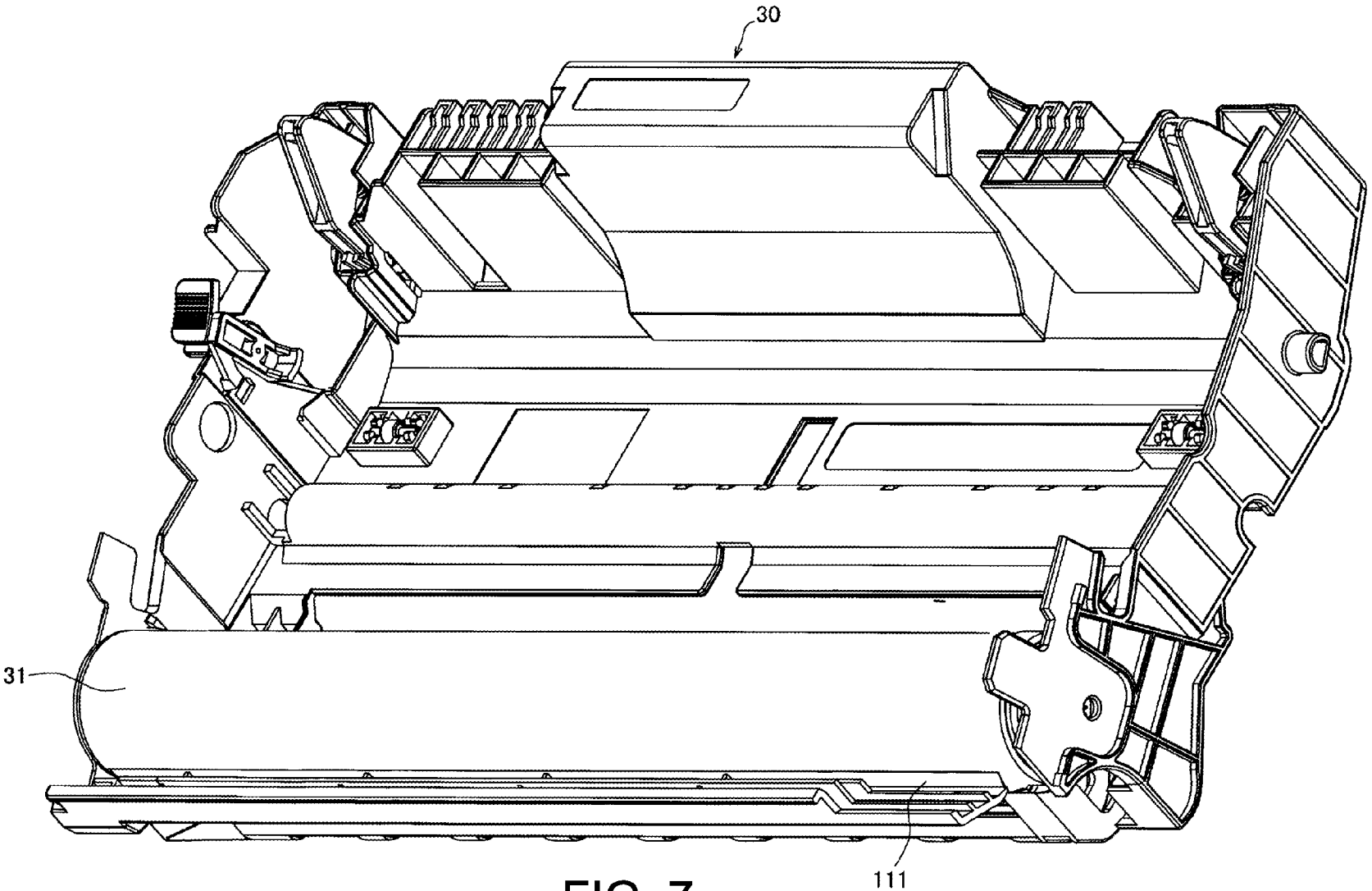
FIG. 7 is a perspective view of the core of the photosensitive cartridge of FIG. 1 according to another illustrative aspect of the invention.
Figure 8:
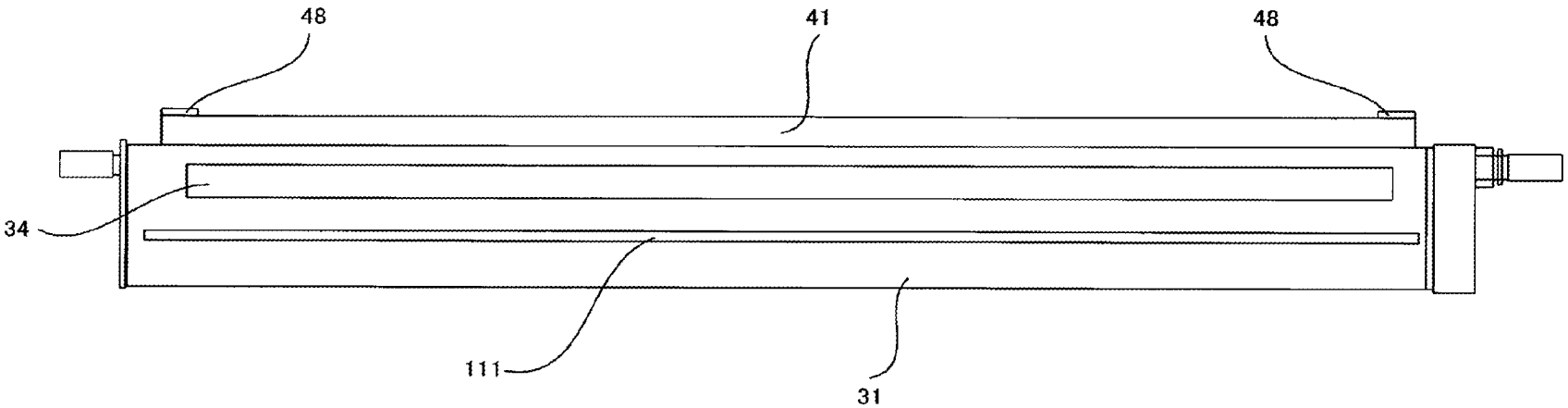
FIG. 8 illustrates the relationships and locations of the major parts of the photosensitive cartridge in FIG. 7.
Figure 9:
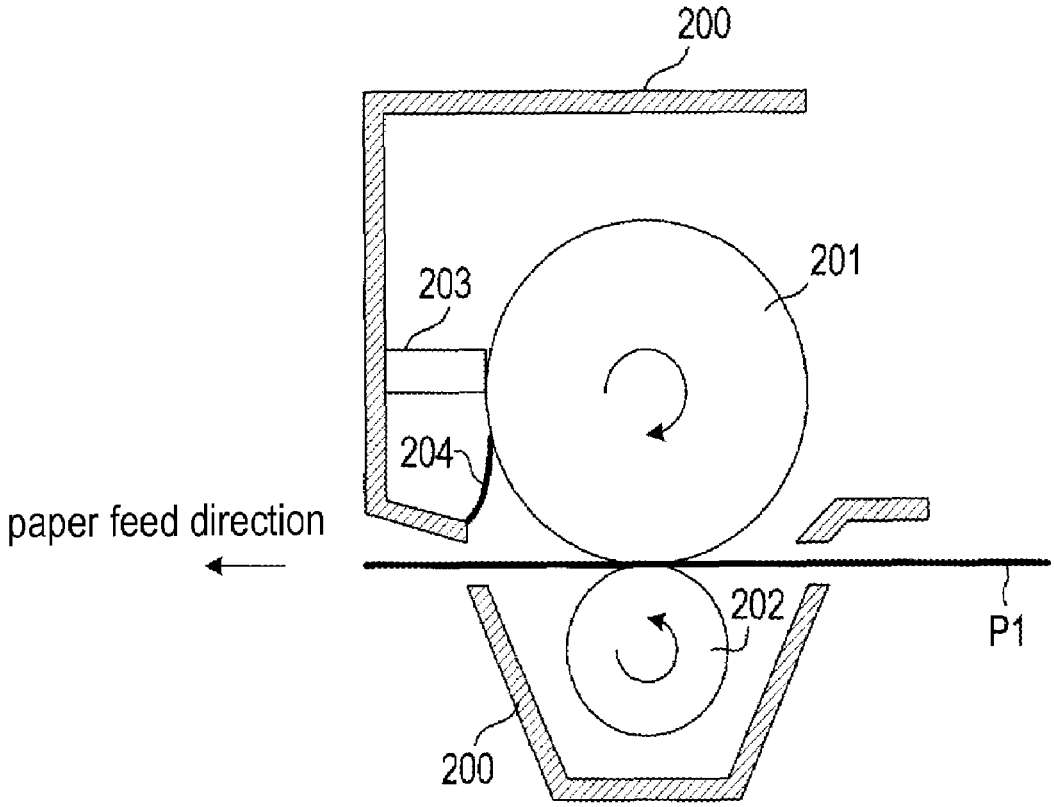
FIG. 9 (prior art)
FIG. 9 illustrates selected components of a conventional photosensitive cartridge.

FIG. 7 is a perspective view of the core of a photosensitive cartridge 30 according to aspects of the invention. FIG. 8 exhibits the relationships and locations of the photosensitive drum 31, the developing roller 41, the conductive brush 34, and the film 111 of FIG. 7.

As shown in FIG. 7 and FIG. 8, the differences between the laser printer 1 according to these aspects of the invention when compared with the laser printer 1 described in connection with FIGS. 3 and 4 is the elimination of the film 35 and the addition of a film 111.

The film 111, similar to the film 35, can block the gap between the photosensitive drum 31 and the dust collector 39. The tips of the film 111 are in contact with the photosensitive drum 31 and the dust collector 39 collects the dust removed by the conductive brush 34 along with the film 111.

As shown in FIG. 8, the width of the film 111 along the axial direction of the drum (film width) is less than the width of the photosensitive drum 31 (photosensitive drum width) in its axial direction, but greater than the width of the development roller 41 (development roller width) in the axial direction of the drum 31.

In such a laser printer 1, the film 111 extends to the portion where the sponge material part 36 extends as shown in FIG. 4. In this manner, a lesser number of components to collect the dust may be used when compared to, for example, the aspects of the invention described with respect to FIG. 4.

While certain aspects of the invention have been discussed above, the present invention is not limited to the above described aspects. Many modifications are possible and may be realized as understood by one of ordinary skill in the art.

For example, a sponge material can be used to collect dust as described. However, in place of a sponge material any material with some degree of elasticity can be used as long as the material can be pressed on the peripheral surface of the photosensitive drum 31 without damaging the surface.

Additionally, aspects of the invention are not limited to a monochrome laser printer and may also be applied to a color laser printer.

What is claimed is:

1. An image forming apparatus comprising:

a rotating image carrier for carrying a latent image, the image carrier including a central portion and tip portions;

a rotating developing element for contacting the rotating image carrier and applying a developer to the latent image to form a visible image on the rotating image carrier, an axial direction of the rotating developing element being parallel to an axial direction of the rotating image carrier, the rotating developing element including tip portions at ends in the axial direction of the rotating image carrier;

a member for removing dust from the central portion of the rotating image carrier, a width of the member in the axial direction of the rotating image carrier being less than a width of the rotating developing element and a width of the rotating image carrier in the axial direction of the rotating image carrier; and a dust collector for collecting dust removed from the rotating image carrier by the member, the dust collector having a width greater than the width of the rotating developing element in the axial direction of the rotating image carrier.

2. The image forming apparatus of claim 1, wherein the width of the rotating developing element is smaller than a width of the rotating image carrier in the axial direction, and the tip portions of the rotating image carrier extend beyond the ends of the tip portions of the rotating development carrier in the axial direction.

3. The image forming apparatus of claim 1, wherein the dust collector consists of a film.

4. The image forming apparatus of claim 1, wherein the dust collector includes a first dust collecting portion and a second dust collecting portion at tip portions of the first dust collecting portion in the axial direction of the rotating image carrier, a width of the first dust collecting portion being greater than a width of the member in the axial direction of the rotating image carrier and less than the width of the rotating development element in the axial direction of the rotating image carrier.

5. The image forming apparatus of claim 4, wherein the second dust collecting portion includes a sponge material.

6. The image forming apparatus of claim 4, wherein the first dust collecting portion includes a film.

7. The image forming apparatus of claim 1, wherein the dust collector includes a sponge material at tip portions in the axial direction of the rotating image carrier.

8. The image forming apparatus of claim 1, wherein the dust collector substantially prevents dust from migrating from the rotating image carrier to the rotating developing element.

9. The image forming apparatus of claim 1, wherein the central portion of the rotating image carrier includes a portion for contacting a recording medium, a width of the portion being less than a width of the member in the axial direction of the rotating image carrier.

10. The image forming apparatus of claim 1, wherein the width of the dust collector is less than the width of the rotating image carder in the axial direction of the rotating image carrier.

11. An image forming apparatus comprising:

a rotating image carrier for carrying a latent image, the image carrier including a central portion and tip portions;

a rotating developing element for contacting the rotating image carrier and applying a developer to the latent image to form a visible image on the rotating image carrier, an axial direction of the rotating developing element being parallel to an axial direction of the rotating image carrier, the rotating developing element including tip portions at ends in the axial direction of the rotating image carrier;

a member for removing dust from the central portion of the rotating image carrier, a width of the member in the axial direction of the rotating image carrier being less than a width of the rotating developing element and a width of the rotating image carrier in the axial direction of the rotating image carrier; and a dust collector for collecting dust removed from the rotating image carrier by the member, the dust collector including a first dust collecting portion and a second dust collecting portion at tip portions of the first dust collecting portion in the axial direction of the rotating image carrier, the second dust collecting portion protruding away from a periphery of the first dust collecting portion and the axial direction of the rotating image carrier.

12. The image forming apparatus of claim 11, wherein the second dust collecting portion protrudes away from the axial direction of the rotating image carrier at an angle between 75 and 105 degrees.

13. The image forming apparatus of claim 12, wherein the angle is perpendicular to the axial direction of the rotating image carrier.

14. The image forming apparatus of claim 11, wherein the first dust collecting portion includes a film.

15. The image forming apparatus of claim 11, wherein the second dust collecting portion has a coefficient of friction less than a coefficient of friction of the rotating imaging forming carrier.

16. The image forming apparatus of claim 15, wherein the second dust collecting portion includes a sponge material.

17. The image forming apparatus of claim 11, wherein the second dust collecting portion includes a plastic material.

18. The image forming apparatus of claim 11, wherein the dust collector substantially prevents dust from migrating from the rotating image carrier to the rotating developing element.

19. The image forming apparatus of claim 11, wherein a width of the first dust collecting portion is greater than a width of the member in the axial direction of the rotating image carrier and less than the width of the rotating development element in the axial direction of the rotating image carrier.

* * * * *